US006540296B1

(12) United States Patent
Shats et al.

(10) Patent No.: US 6,540,296 B1
(45) Date of Patent: Apr. 1, 2003

(54) CHAIR BACK HEIGHT-ADJUSTMENT MECHANISM

(75) Inventors: Michael Shats, Thornhill (CA); William Stumpf, Kitchener (CA); Vaclav Pernicka, Brampton (CA)

(73) Assignee: Ram Machines (1990) Ltd., Downsview (CA)

( * ) Notice: Subject to any disclaimer, the term of this patent is extended or adjusted under 35 U.S.C. 154(b) by 0 days.

(21) Appl. No.: 09/795,144

(22) Filed: Mar. 1, 2001

(51) Int. Cl.[7] ..... B60N 2/02
(52) U.S. Cl. ..... 297/353; 297/411.36
(58) Field of Search ..... 297/353, 410, 297/411.36; 74/89.17, 575

(56) References Cited

U.S. PATENT DOCUMENTS 2,509,102 A * 5/1950 Kuebler ..... 297/353
5,649,741 A 7/1997 Beggs
5,685,609 A 11/1997 Miotto
6,132,001 A * 10/2000 Su ..... 248/161

* cited by examiner

*Primary Examiner*—Peter M. Cuomo
*Assistant Examiner*—Erika Garrett
(74) *Attorney, Agent, or Firm*—Bereskin & Parr

(57) ABSTRACT

A mechanism for adjusting the height of a chair back relative to the seat includes an arm that extends upwardly from the rear of the seat, and a carriage that is carried by the back and slidably mounted on the arm. A pinion inside the carriage engages a rack on the arm so that the pinion travels along the rack when the chair back is moved up and down on the arm. A pawl engages the pinion when the chair back is moved upwardly so as to allow incremental adjustment in the height of the back in the upward direction, while preventing downward movement of the back. When the back reaches the upper limit of its travel, an actuator spring is displaced downwardly, disengaging the pawl so that the back is free to slide on the arm. At the bottom of the limit of travel, the spring is displaced upwardly, re-engaging the pawl.

10 Claims, 6 Drawing Sheets

CHAIR BACK HEIGHT-ADJUSTMENT MECHANISM

FIELD OF THE INVENTION

This invention relates to a mechanism for adjusting the height of a chair back relative to the seat of the chair.

BACKGROUND OF THE INVENTION

The invention has been devised in the context of back height adjustment mechanisms for office chairs. A chair of this type typically includes a seat supported on a base provided with castors. A generally L-shaped arm extends rearwardly from below the seat and then upwardly and the back is coupled to the upright limb of the arm so that the back can be adjusted height-wise on the limb to suit the comfort and preference of the user of the chair.

A simple form of adjustment mechanism includes a bolt having a head in the form of a large knob or knurled handle that can be turned manually by the person adjusting the chair to clamp the back to the arm. Adjustment is essentially a two-handed operation in that the bolt must be loosened while the back is supported and then moved to an adjusted position. The back is then held in that position while the bolt is re-tightened.

More recently, adjustment mechanisms have become available that can be operated easily using one hand. U.S. Pat. No. 5,649,741 (Beggs) and U.S. Pat. No. 5,685,609 (Miotto) both disclose adjustment mechanisms of this type in which a pawl carried by the chair back engages a rack on the upright limb of the arm. As the back is raised, the pawl ratchets along the rack until an appropriate adjusted position is reached. If the chair back is moved to the top of its travel, the pawl disengages and the back can be moved down to a bottom position, where the pawl re-engages and the adjustment process can start again.

SUMMARY OF THE INVENTION

An object of the present invention is to provide an improved chair back height-adjustment mechanism.

The mechanism provided by the invention includes first and second structural members that are adapted to be connected to the seat and back respectively and are coupled to one another for relative sliding movement along a defined axis along which the back is to be adjusted with respect to the seat. A rack is provided on the first structural member and extends in the direction of the defined axis. A pinion carried by the second structural member engages the rack so that the pinion can rotate and move along the rack in response to relative movement between the first and second structural members along the said axis. A pawl is pivotally mounted on the second structural member for movement between (a) a position in which the pawl engages the pinion and permits rotation of the pinion in one rotational direction only corresponding to relative movement between the first and second structural members for height-wise adjustment of the chair back in a first direction along said axis, while preventing relative movement between the first and second structural members in a second, opposite direction, and (b) a disengaged position in which the pawl is clear of the pinion and the first and second structural members are free for movement in either said direction. Actuator means is carried by the second structural member for moving the pawl between its engaged and disengaged positions at respective limits of travel of the first and second structural members with respect to one another along said axis.

Typically, the first structural member of the mechanism comprises an arm that extends upwardly from the seat of the chair and the second structural member is a carriage that rides on the arm and is coupled to the back. While the mechanism can be designed to operate in either direction, the arrangement preferably is such that the back is moved incrementally in the upward direction to find a suitable adjusted position. When the limit of travel in that direction is reached, the actuator means disengages the pawl from the pinion so that the back can be moved freely downwardly to the bottom limit of its travel where the pawl is re-engaged so that the adjustment process can start again.

The first structural member (arm) may be connected directly to the seat but normally will be connected to the seat via the chair base.

It is believed that a rack and pinion adjustment mechanism of the form provided by the invention offers a number of significant advantages over the prior art, particularly those exemplified by the Beggs and Miotto patents referred to previously. The use of a rack and pinion allows the use of a finer tooth pitch so that finer increments of adjustment are possible. Also, the mechanism can be designed to operate more quietly. A number of other practical advantages are offered, in terms of ease of assembly and lower cost.

BRIEF DESCRIPTION OF DRAWING

In order that the invention may be more clearly understood, reference will now be made to the accompanying drawings which illustrate a particular preferred embodiment of the invention by way of example, and in which.

DESCRIPTION OF PREFERRED EMBODIMENT

Figure 1:
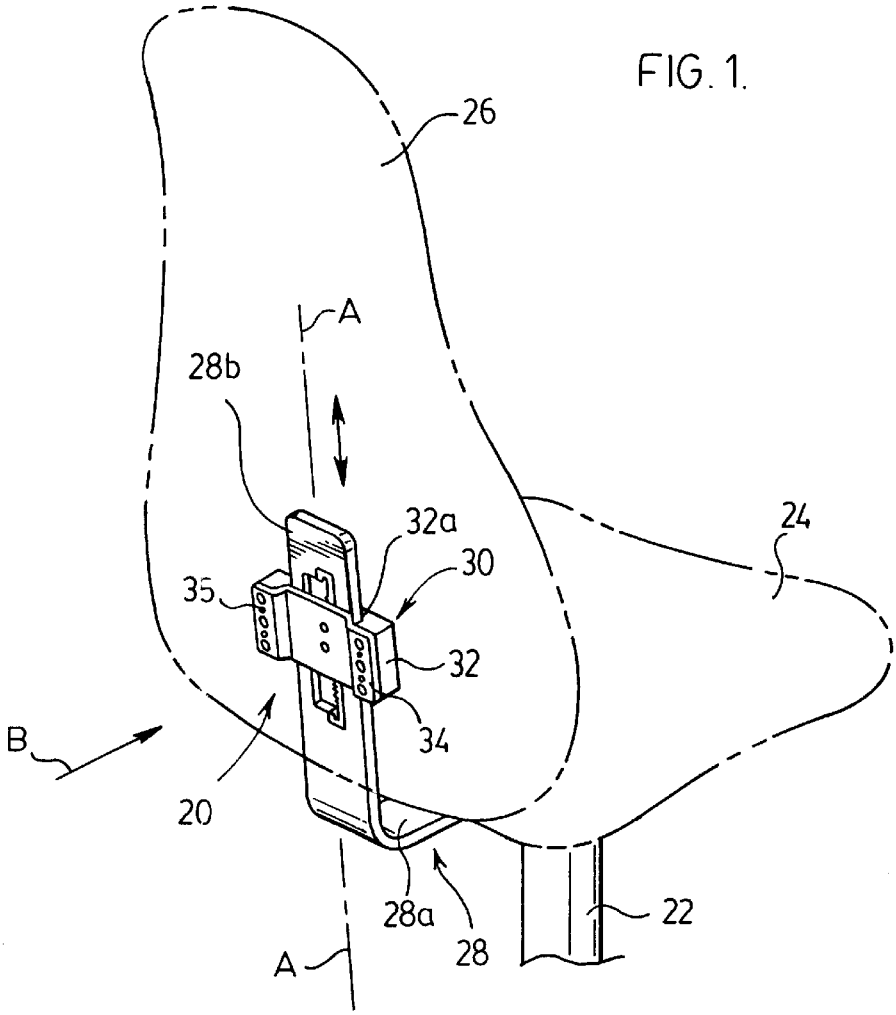
FIG. 1 is a perspective view from the rear showing a chair height-adjustment mechanism in accordance with the invention in association with other components of chair (shown in ghost outline)
Figure 2A:
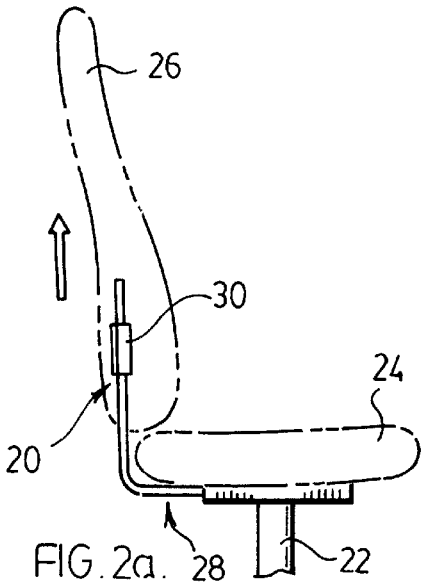
FIG. 2 comprises two side elevational views (a) and (b) that illustrate the manner in which the height of the back can be adjusted.
Figure 2B:
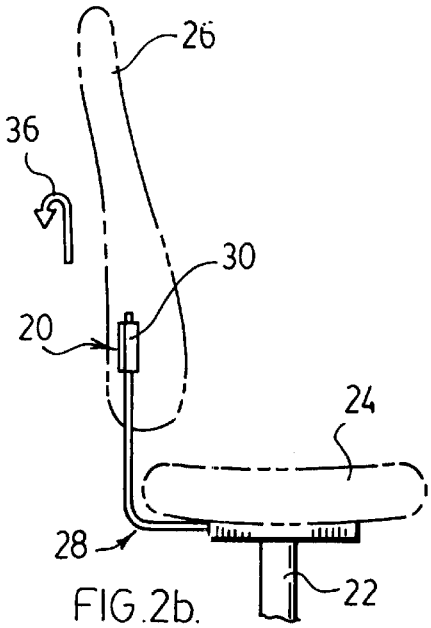

Referring first to FIG. 1, a chair back height-adjustment mechanism in accordance with the invention is generally indicated by reference numeral 20 and is shown in association with a typical office chair shown in ghost outline. The chair has a base, part of which is indicated at 22, that supports a seat 24, and a back denoted 26 that is coupled to the base 22 by the adjustment mechanism 20. The mechanism includes first and second structural members, namely an arm or bracket 28 and a carriage 30. As best seen in FIG. 2, arm 28 is generally L-shaped and includes a horizontal limb 28*a* that is coupled to the seat 24 via the chair base 22, and a vertical limb 28*b* that extends upwardly behind the back 26. Carriage 30 is mounted to slide up and down the vertical limb 28*b* of arm 28 along a defined axis denoted A—A and is secured to the back 26.

Arm 28 is essentially a flat rectangular section steel bar having a right-angled configuration. The carriage 30 is designed to embrace the upright limb 28*b* of arm 28 so that the carriage can slide up and down on the arm. The principal components of the carriage 30 are a backing member 32 that defines a recess 32*a* generally complimentary to the cross-sectional shape of the upright limb 28*b* of arm 28, and a front plate 34 that is secured by screws 35 to the backing member 32 so as to lie in sliding contact with the outer face of limb 28*b*.

FIG. 2(*a*) shows the chair in a configuration in which the back 26 is in a bottom position close to the seat 24. As will become apparent later, the height adjustment mechanism of the invention allows the back 26 to be raised in increments from the bottom position shown in FIG. 2(*a*) to a top position shown in FIG. 2(*b*). Once the carriage 32 reaches the top of its travel with respect to the vertical limb 28*b* of arm 28, the mechanism releases and the carriage (and back) can be slid freely down limb 28*b* as indicated by the arrow 36 to the bottom position shown in FIG. 2(*a*), from which the adjustment process can be resumed.

Figure 3:
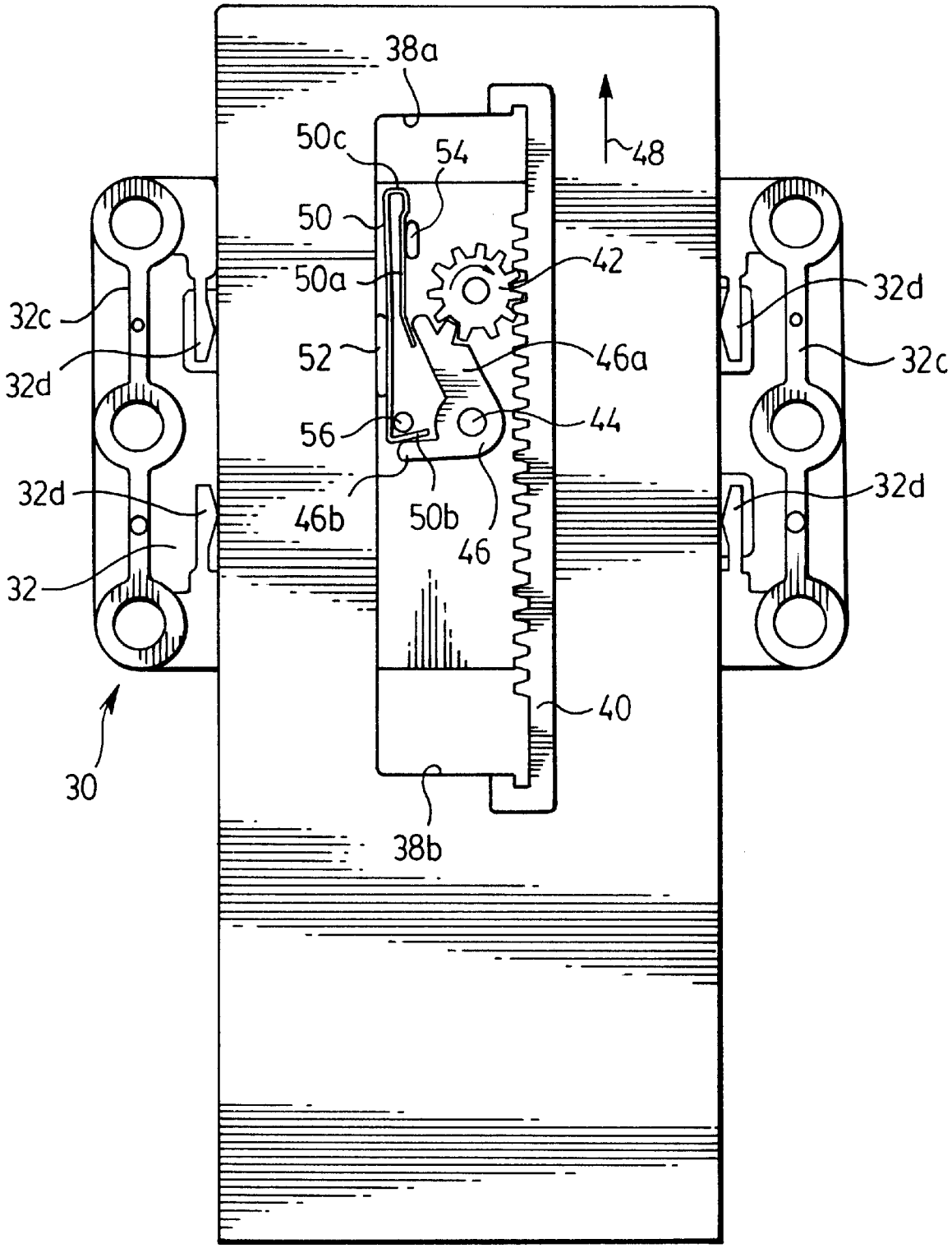
FIG. 3 is an elevational view in the direction of arrow B in FIG. 1 with a front plate of the mechanism removed to show internal components.
Figure 4:
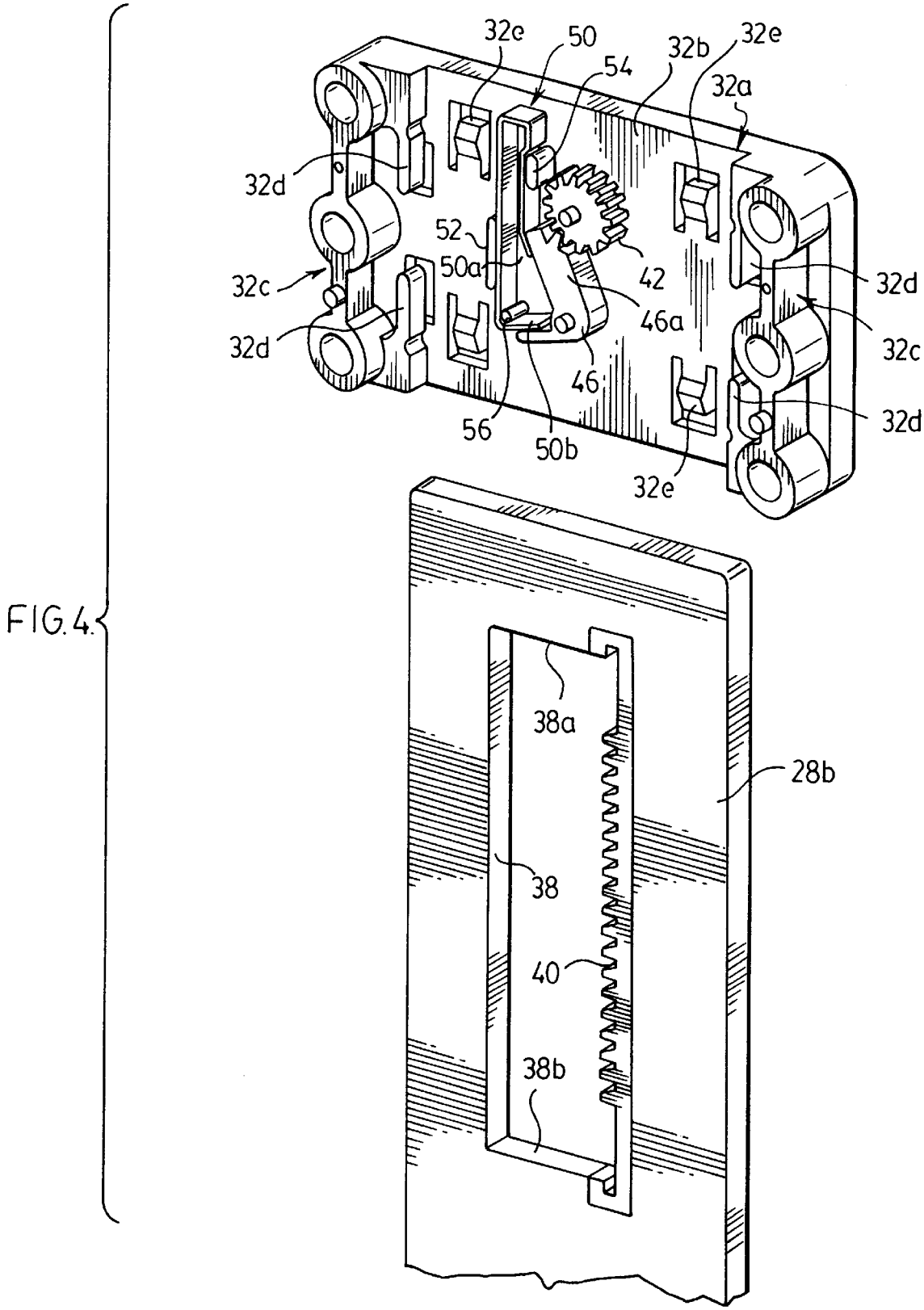
FIG. 4 is an exploded perspective view corresponding to FIG. 3.

FIG. 3 shows the adjustment mechanism of the invention as seen in the direction of arrow B in FIG. 1 but with the plate 34 removed. FIG. 4 shows the same components as FIG. 3 with the backing member 32 of carriage 30 in an exploded position above the upright limb 28*b* of arm 28. Limb 28*b* is formed with a vertically elongate, generally rectangular recess 38, one vertical side edge of which is fitted with a rack 40. Typically, the rack 40 is formed separately from the arm 28 and press-fitted into recess 38.

The backing member 32 of carriage 30 is a plastic moulding, the shape of which is best seen in FIG. 4. Recess 32*a* of the moulding has a flat back wall 32*b* which confronts the rear face of limb 28*b* and moulded formations 32*c* that slide against the side edges of limb 28*b*. Formations 32*c* also provide surfaces against which plate 34 is secured by screws (not shown) that extend through openings 34*a* (FIG. 5) in plate 34.

Figure 5:
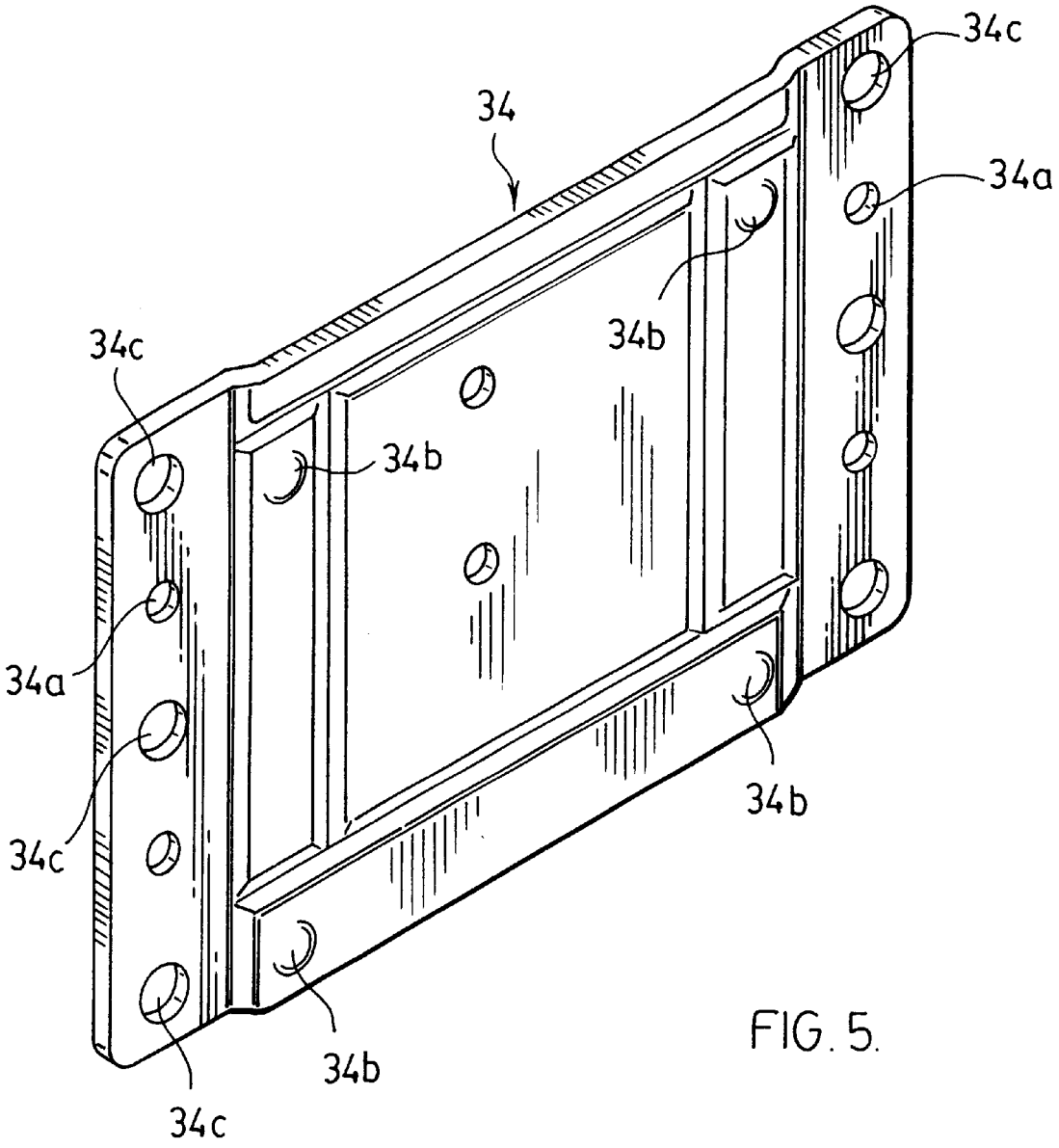
FIG. 5 is a perspective view of the front plate of the mechanism, showing its inner-face; and, FIGS. 6 to 9 are elevational views similar to FIG. 3 illustrating sequential steps in the operation of the mechanism.

Carriage 30 is designed for low-friction sliding movement on limb 28*b* while providing a low clearance or tolerance between the carriage and the limb. In other words, the carriage can slide freely up and down on the limb but remains stable and will not "wobble" or bind as it moves. To this end, the formations 32*c* of the backing member moulding include a pair of flexible tabs 32*d* at each side that make contact with the side edges of limb 28*b* and the back wall 32*b* of the moulding includes four flexible tabs 32*e* that provide for line contact between moulding 32 and the rear face of limb 28*b*. Similarly, the inner face of the front plate 34 of carriage 30 is embossed in corner regions to provide four raised dimples or "pips" 34*b*, as shown in FIG. 5, that make point contact with the front face of limb 28*b*.

In other words, the flexible tabs 32*d* and 32*e* of moulding 32 and the dimples 34*b* of plate 34 take up clearance or tolerance between the carriage 30 and the limb 28*b*, while at the same time minimizing friction between the carriage and the limb.

Side margins of plate 34 have openings 34*c* that match similar openings in the formations 32*c* of backing member 32 to receive bolts or screws (not shown) for securing carriage 30 to the seat back 26.

A pinion 42 is rotationally mounted on surface 32*b* in a position to engage the teeth of rack 40 when the carriage is in position on arm 28. Mounted to surface 32*b* by a pivot pin 44 is a pawl 46 that has two limbs 46*a* and 46*b*. Pin 44 allows pawl 46 to pivot between a position in which limb 46*a* is engaged with pinion 42 as shown in FIG. 3 and a position in which the pawl is disengaged from the pinion as shown, for example, in FIGS. 7 and 8. In the engaged position of FIG. 3, pawl 46 allows rotation of pinion 42 in the clockwise direction in response to upward movement of carriage 30 (arrow 48) but prevents rotation of pinion 42 in the opposite direction. In other words, when the pawl is engaged with the pinion 42, carriage 30 can move upwardly in increments for adjusting the vertical height of the seat back 26, but downward movement is prevented. In the "pawl disengaged" position of the FIGS. 7 and 8, however, pinion 42 is free to turn so that the carriage 30 can move freely on the upright limb 28*b* of arm 28.

The height-adjustment mechanism of the invention includes actuator means for pawl 46 comprising a spring 50 that acts on pawl 46 to, at appropriate times, either bias limb 46*a* into engagement with pinion 42 or bias the limb 46*b* of pawl 46 downwardly to retract the pawl from engagement with pinion 48. The actuator spring 50 is displaceable in the direction of the defined axis A—A to appropriately actuate the pawl 46, by abutment with end stops provided by top and bottom surfaces respectively of the opening 38 in which the rack 40 is formed. In this way, the pawl is automatically disengaged from pinion 42 when the carriage 30 reaches the upper limit of its travel, so that the carriage can then move freely down on limb 28*b*, and is re-engaged with the pinion 42 at the lower limit of its travel.

In more detail, it will be seen from FIG. 3 that spring 50 is shaped to provide a generally hook-shaped upper portion having a limb 50*a* that bears against limb 46*a* of pawl 46, and a lower angled limb 50*b* that cooperates with the bottom limb 46*b* of pawl 46. The spring is constrained for sliding movement by three formations that project from surface 32*b* of backing member 32. These projections comprise a rear tab 52 which provides an upright sliding surface for the spring, a tab 54 that constrains the upper hook-shaped portion of the spring, and a pin 56 that locates the bottom limb 50*b* of the spring.

Figure 7:
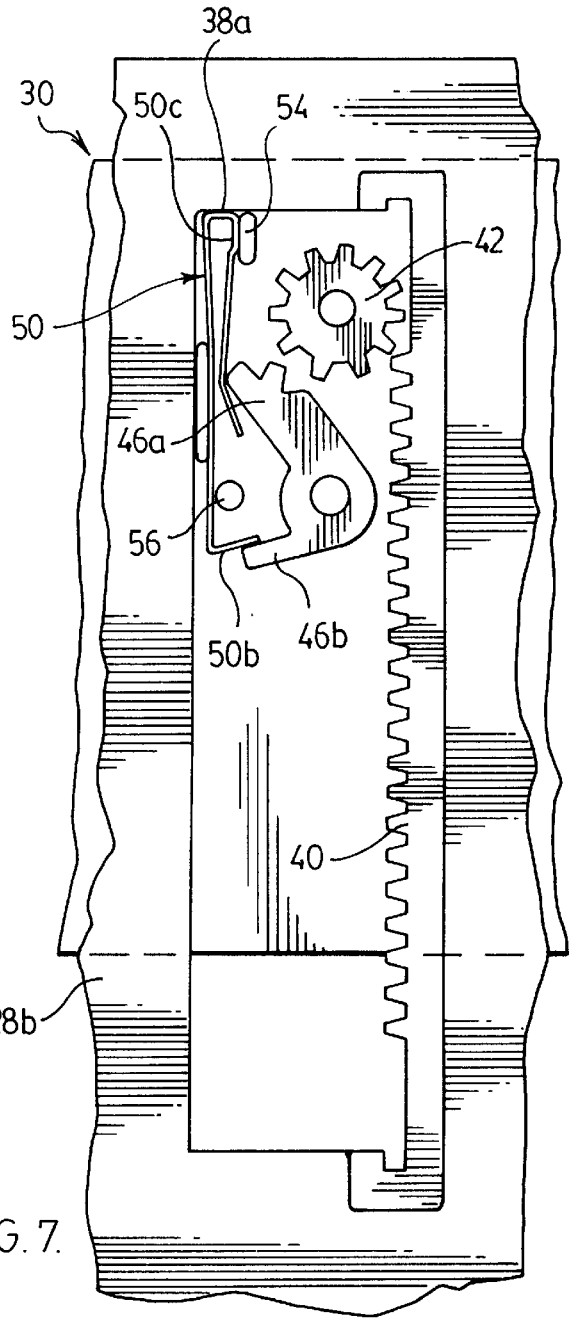

When carriage 30 reaches the upper limit of its travel, the top end of spring 50 abuts against an end stop provided by a top inner surface 38*a* of opening 38 in limb 28*b*. The spring is pushed downwardly with respect to the projection 52, 54 and 56. Immediately above projection 54 in the position FIG. 3, is a slightly outwardly curved portion 50*c* of spring 50. Spring portion 50*c* is pressed inwardly by projection 54 as the spring moves down, as best shown in FIG. 7. This causes the hook-shaped upper portion of the spring to be compressed somewhat, reducing the biassing effect of spring limb 50*a* of pawl limb 46*a*. At the same time, the whole spring is displaced downwardly so that the bottom limb 50*b* of the spring acts on pawl limb 46*b* to disengaged the pawl from the pinion.

Figure 6:
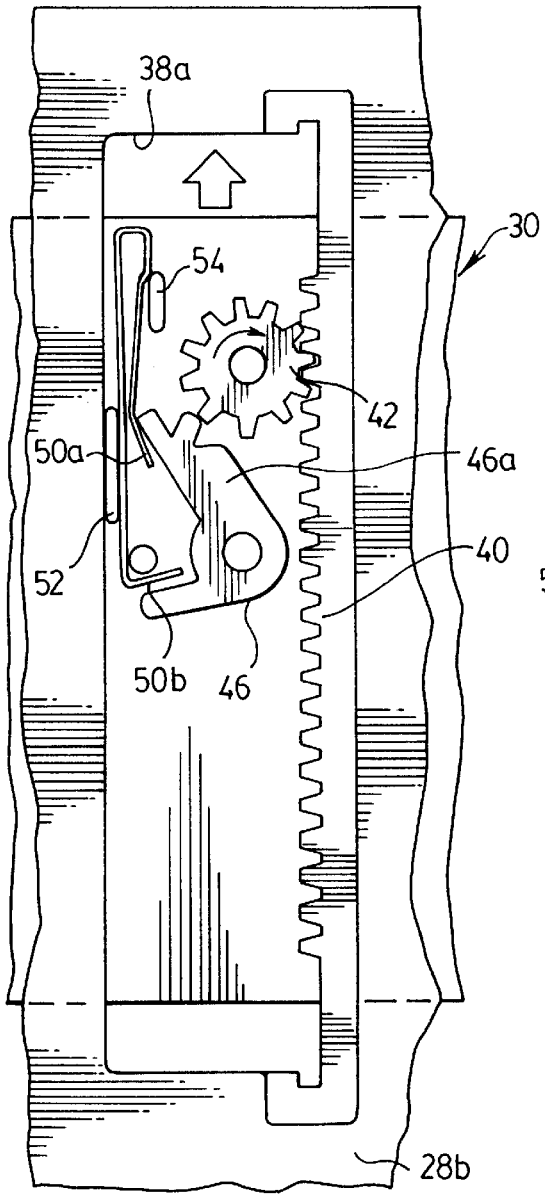

FIGS. 6 and 7 best show this sequence of events. In FIG. 6, carriage 30 is moving up towards the upper limit of its travel. In FIG. 7, the spring has contacted the end stop 38*a* and been displaced downwardly so that the pawl is retracted from pinion 42. The carriage can then move freely down on arm 28.

Figure 8:
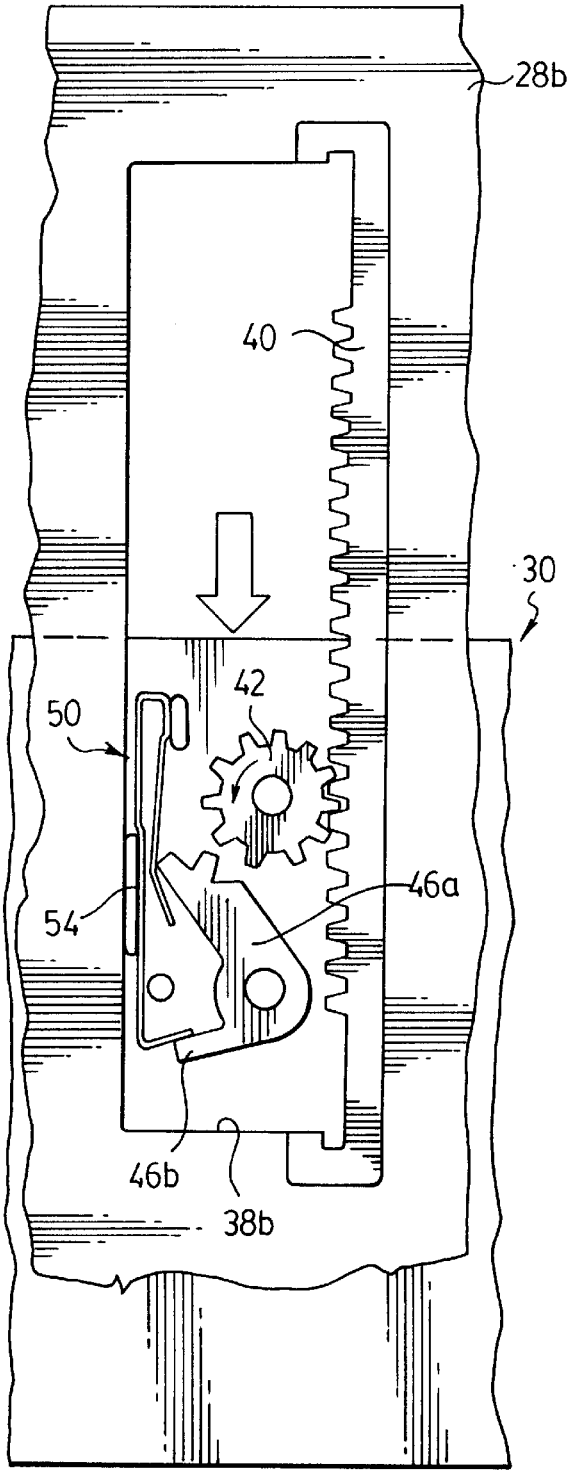
Figure 9:
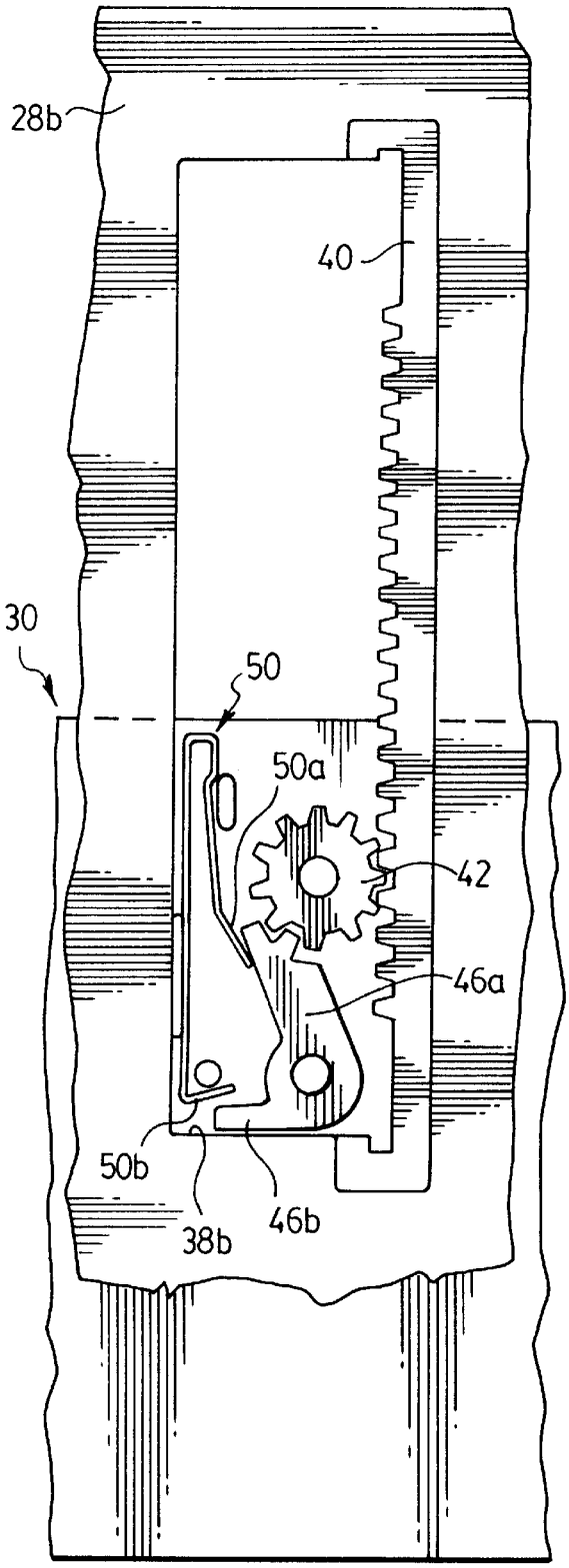

FIG. 8 shows the carriage approaching the bottom limit of its travel with the pawl 46 still out of engagement with pinon 42. In this condition, the carriage is free to move down (or up) on limb 28*b*. When the carriage reaches the bottom limit of its travel, stop surface 38*b* of recess 38 is contacted by the bottom limb 46*b* of pawl 46 so that the spring 50 is displaced upwardly, causing its upper end portion 50*a* to urge the pawl 46 back into engagement with pinion 42.

Vertical adjustment of the height of the back can then proceed in increments determined by the pitch of the teeth on rack 40 and pinion 42. In other words, the user moves the back upwardly in increments until the desired adjusted position is reached. The back will then remain in that position (unless further adjustments is made) and is prevented from moving down by engagement of the pawl 46 with pinion 42 and engagement of the pinion 42 with rack 40.

It will of course be appreciated that the preceding description relates to a particular preferred embodiment of the invention and that many modifications are possible.

For example, a different form of actuator could be provided for moving the pawl between its engaged and disengaged positions. The pawl 46 could be provided with detents that positively define its engaged and disengaged positions and the pawl could be displaced between those positions by contact with end stops provided on limb 28*b*.

More generally, the arrangement could be reversed so that the back is adjusted in the downward direction by movement of carriage 30. Also, the structural design could be reversed so that the rack is provided on the carriage and the pinion and pawl on the arm 28. It might even be possible for the carriage (30) to be connected to the chair seat and the arm (28) to the back. For example, the arm could extend downwardly into engagement with a carriage supported by a bracket on the seat base.

Having said that, it is believed that the design of the preferred embodiment combines the virtues of simplicity and low cost with functionality. The mechanism is found to operate efficiently and quietly. Fine incremental adjustment can be provided by providing a fine pitch rack and pinion. Variations in tolerance between arm 28 and carriage 30, for example, due to variations in the width of arm 28 are controlled by means of moulded plastic tabs in the backing member of carriage 30. At the same time, the backing member and front plate 34 make point contact with the arm, for minimizing frictional resistance.

In an alternative embodiment, carriage 30 could of course be made as two complimentary mouldings that embrace the arm, rather than as a backing member and front plate.

We claim:

1. A mechanism for adjusting the height of a chair back relative to a seat, comprising:

first and second structural members adapted to be connected to the seat and back respectively and coupled to one another for relative sliding movement along a defined axis along which the back is to be adjusted with respect to the seat;

a rack on said first said structural member extending in the direction of said defined axis;

a pinion carried by the second said structural member and engaged with the rack;

a pawl pivotally mounted on the second structural member for movement between (a) an engaged position in which the pawl engages the pinion and permits rotation of the pinion in one direction only corresponding to relative movement between the first and second structural members for height-wise adjustment of chair back in a first direction along said axis, while preventing relative movement between the first and second structural members in a second, opposite direction along said axis, and (b) a disengaged position in which the pawl is clear of the pinion and the first and second structural members are free for movement in either said direction; and actuator means carried by said second structural member for moving the pawl between said engaged position and said disengaged position at respective limits of travel of the first and second structural members with respect to one another along said axis;

wherein said actuator means includes a spring that co-operates with the pawl for selectively biassing the pawl towards said engaged position or said disengaged position, and respective end-stop means on said first structural member co operating with the spring, the spring being longitudinally displaceable by contact with said end stop means at said limits of travel to move the pawl between its engaged position and its disengaged position;

and wherein said pawl includes a first limb for engagement with said pinion and a second limb that is angularly disposed with respect to said first limb, and wherein said spring acts on said second limb to withdraw the first limb of the pawl from the pinion as a consequence of said longitudinal displacement of the spring in one direction, and wherein said second limb of the pawl is arranged to co-operate with the relevant said end stop means to cause longitudinal displacement of the spring in the opposite direction to move the first limb of the pawl into engagement with the pinion.

2. A mechanism as claimed in claim 1, wherein the first structural member comprises an arm that is adapted to extend upwardly from the seat of the chair, and wherein the second structural member comprises a carriage that rides on the arm and is adapted to be coupled to the back of the chair.

3. A mechanism as claimed in claim 2, wherein the arm is formed with a recess and wherein the pinion, pawl and actuator means are disposed in said recess and carried by the carriage, and wherein the rack extends along a side edge of said recess in engagement with the pinion.

4. A mechanism as claimed in claim 1, wherein said heightwise adjustment of the chair back in a first direction along said axis corresponds to upward movement of the back with respect to the seat, whereby the back is adjusted with respect to the seat during upward movement of the back, in increments determined by the pitch of the rack and pinion.

5. A mechanism as claimed in claim 2, wherein the carriage comprises a backing member which is shaped to define a recess complimentary to the cross-sectional shape of the arm, for receiving the arm, and a front plate which is coupled to the backing member so as to extend across a front face of the arm and enclose the arm in the recess, wherein the front plate is provided with a number of protrusions that make point contact with the front face of the arm, and wherein the backing member is provided with a plurality of flexible tabs that make line contact with a rear face and side edges of the arm, said point contacts minimizing frictional resistance to movement of the carriage along the arm and said flexible tabs accommodating clearance between the arm and the carriage.

6. A mechanism for adjusting the height of a chair back relative to a seat, comprising:

first and second structural members adapted to be connected to the seat and back respectively and coupled to one another for relative sliding movement along a defined axis along which the back is to be adjusted with respect to the seat;

a rack on said first said structural member extending in the direction of said defined axis;

a pinion carried by the second said structural member and engaged with the rack;

a pawl pivotally mounted on the second structural member for movement between (a) an engaged position in which the pawl engages the pinion and permits rotation of the pinion in one direction only corresponding to relative movement between the first and second structural members for height-wise adjustment of chair back in a first direction along said axis, while preventing relative movement between the first and second structural members in a second, opposite direction along said axis, and (b) a disengaged position in which the pawl is clear of the pinion and the first and second structural members are free for movement in either said direction; and actuator means carried by said second structural member for moving the pawl between said engaged position and said disengaged positions at respective limits of travel of the first and second structural members with respect to one another along said axis;

wherein the first structural member comprises an arm that is adapted to extend upwardly from the seat of the chair, and wherein the second structural member comprises a carriage that rides on the arm and is adapted to be coupled to the back of the chair;

and wherein the carriage comprises a backing member which is shaped to define a recess complimentary to the cross-sectional shape of the arm, for receiving the arm, and a front plate which is coupled to the backing member so as to extend across a front face of the arm and enclose the arm in the recess, wherein the front plate is provided with a number of protrusions that make point contact with the front face of the arm, and wherein the backing member is provided with a plurality of flexible tabs that make line contact with a rear face and side edges of the arm, said point contacts minimizing frictional resistance to movement of the carriage along the arm and said flexible tabs accommodating clearance between the arm and the carriage.

7. A mechanism as claimed in claim 6, wherein the arm is formed with a recess and wherein the pinion, pawl and actuator means are disposed in said recess and carried by the carriage, and wherein the rack extends along a side edge of said recess in engagement with the pinion.

8. A mechanism as claimed in claim 6, wherein said heightwise adjustment of the chair back in a first direction along said axis corresponds to upward movement of the back with respect to the seat, whereby the back is adjusted with respect to the seat during upward movement of the back, in increments determined by the pitch of the rack and pinion.

9. A mechanism as claimed in claim 6, wherein said actuator means includes a spring that co-operates with the pawl for selectively biassing the pawl towards said engaged position or said disengaged position, and respective end-stop means on said first structural member co operating with the spring, the spring being longitudinally displaceable by contact with said end stop means at said limits of travel to move the pawl between its engaged position and its disengaged position.

10. A mechanism as claimed in claim 9, wherein said pawl includes a first limb for engagement with said pinion and a second limb that is angularly disposed with respect to said first limb, and wherein said spring acts on said second limb to withdraw the first limb of the pawl from the pinion as a consequence of said longitudinal displacement of the spring in one direction, and wherein said second limb of the pawl is arranged to cooperate with the relevant said end stop means to cause longitudinal displacement of the spring in the opposite direction to move the first limb of the pawl into engagement with the pinion.

* * * * *